US007063058B1

(12) United States Patent
Armour et al.

(10) Patent No.: US 7,063,058 B1
(45) Date of Patent: Jun. 20, 2006

(54) CAMSHAFT PHASER BIAS SPRING MECHANISM

(75) Inventors: Paul A. Armour, Rochester, NY (US); Natalie G. Payne, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/118,144

(22) Filed: Apr. 29, 2005

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,439,184 B1 * 8/2002 Takenaka et al. ..... 123/90.17

* cited by examiner

*Primary Examiner*—Thomas Denion
*Assistant Examiner*—Zelalem Eshete
(74) *Attorney, Agent, or Firm*—Patrick M. Griffin

(57) ABSTRACT

In a prior art camshaft phaser having a biasing spring, the stator spring tang is anchored to a first binder screw passing through a stator lobe adjacent the locking pin-containing vane of the rotor, and the rotor spring tang is anchored to a first target wheel protrusion opposite such a vane. In an improved installation method in accordance with the invention, during assembly of an improved phaser the biasing spring is rotated about 180° from the prior art position such that the stator spring tang is anchored to a first fixed stop generally opposite the pin-containing vane, and the rotor spring tang is anchored to a second fixed stop generally adjacent such a vane.

19 Claims, 4 Drawing Sheets

CAMSHAFT PHASER BIAS SPRING MECHANISM

TECHNICAL FIELD

The present invention relates to vane-type camshaft phasers for varying the valve timing of internal combustion engines; more particularly, to a spring for biasing a rotor of a camshaft phaser in a predetermined direction; and most particularly, to an improved orientation of a biasing spring, to reduce wear and oil leakage in a camshaft phaser.

BACKGROUND OF THE INVENTION

Vane-type camshaft phasers for varying the timing of valves in internal combustion engines are well known. A typical phaser comprises a rotor attached to a camshaft and a stator surrounding the rotor and driven in time with an engine crankshaft. The phaser is able to vary the angular position of the rotor with respect to the stator and thus to vary the valve timing imposed on the camshaft with respect to the crankshaft and pistons.

A phaser typically includes a spring for biasing the rotor in a specific angular direction with respect to the stator, for example, in a timing-retarding direction. In the prior art, the coiled spring has a first tang (referred to herein as the "stator tang") extending into contact with a fixed stop, such as for example a slot, protruding pin or bolt head grounded to the stator, thus anchoring one end of the spring to the stator. A second tang (referred to herein as the "rotor tang") at the opposite end of the spring coil is grounded to the rotor by attachment directly thereto, of by attachment to a component, such as a target wheel, which is grounded to the rotor. Because the first and second tangs are spaced apart axially of the phaser, the spring produces torque on the rotor not only about the phaser axis but also about a second axis transverse to the phaser axis. This second torque amounts to a cocking of the rotor within the stator, which cocking selectively urges portions of the rotor vanes preferentially against the stator front and rear covers, thereby causing unequal wear on the rotor vanes. As presently installed in a substantial number of different camshaft phasers on the market today, this spring orientation causes wear and cocking of the rotor that can eventually lead to high levels of leakage between the advance and retard chambers, affecting phaser control directly, and also can lead to unacceptably high parasitic losses in total engine oil flow.

In particular, the cocking action lifts the lower rotor surface of the large vane containing a locking pin assembly. Subsequent wear on the other vanes causes a widening clearance between the large vane face and the stator rear cover, thereby affecting control of the locking pin itself as well as an undesirable free flow of oil past the locking pin vane.

What is needed in the art is an improved spring position for the biasing spring of a camshaft phaser wherein wear patterns of the phaser rotor are altered or reduced to reduce parasitic leakage between advance and retard chambers.

It is a principal object of the present invention to reduce leakage between advance and retard chambers due to rotor wear in a camshaft phaser.

SUMMARY OF THE INVENTION

Briefly described, in a prior art camshaft phaser having a biasing spring, the stator spring tang is anchored to a first fixed stop aligned with a stator lobe adjacent the locking pin-containing vane of the rotor, and the rotor spring tang is anchored to a second fixed stop grounded to the rotor generally diametrically opposite the first fixed stop. In an installation method in accordance with the invention, during assembly of a phaser, the biasing spring is rotated about 180° from the prior art position such that the rotor spring tang is anchored to a second fixed stop positioned adjacent the locking-containing vane of the rotor and the stator spring tang is anchored to a first fixed stop generally diametrically opposite the second fixed stop. Cocking of the rotor within the stator is favorably altered such that rotor to stator cover plate contact is redirected toward the large vane face carrying the locking pin, wear is more even and reduced, and leakage between the advance and retard chambers, and particularly across the locking pin, is reduced.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
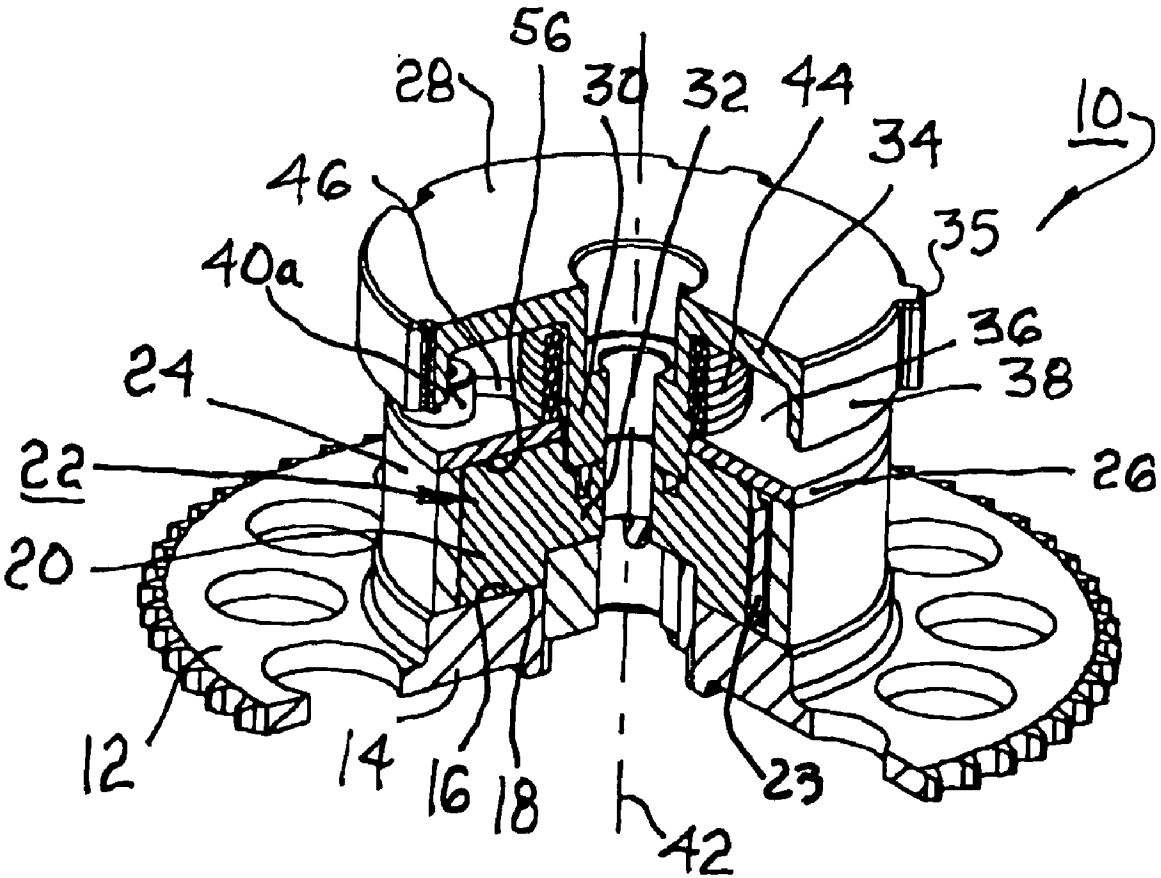
FIG. 1 (PRIOR ART)
FIG. 1 is an isometric view in cutaway of a prior art vane-type camshaft phaser, showing the principal components.

Referring to FIGS. 1 through 4, a prior art vane-type camshaft phaser 10 comprises a toothed drive wheel 12 for being engaged by a timing chain (not shown) driven by the crankshaft (not shown) of an internal combustion engine (not shown) as is well known in the automotive arts. Drive wheel 12 includes a wheel hub 14 having a planar portion which acts as a lower sealing surface 16 for the lower face 18 of a vane 20 of a rotor 22. Surface 16 is also serves as a rear cover to and a lower sealing surface for a stator 24 surrounding rotor 22. A front cover plate 26 is sealingly disposed on stator 24 to enclose rotor 22 within cavity 23 of stator 24 and to form alternating advance and retard chambers (not visible) between the interlocking vanes 20 of rotor 22 and lobes of stator 24 (also not visible but configured in fashion well known in the prior art). A timing wheel 28 has a hub 30 extending through an opening in cover plate 26 into contact with a hub 32 of rotor 22. Timing wheel 28 may be keyed to rotor hub 32 or may be engaged by compressional force during bolting of the phaser to a camshaft, such that the angular position of timing wheel 28 is indicative of an identical angular position of rotor 22. Timing wheel 28 includes a flange 34 off-spaced from cover plate 26 and extending radially to define an annular space 36 therebetween. Timing wheel 28 may further include a skirt 38 for structural strength at the outer edge of flange 34 and for the location of timing teeth 35 for use in conjunction with a timing sensor as known in the art. Cover plate 26 is secured to wheel hub 14 by a plurality of bolts 40, typically four, extending through openings in cover plate 26 and corresponding bores in stator 24.

It has been found desirable to bias rotor 22 in a predetermined angular direction about phaser axis 42, typically into full retard valve timing mode for use on an intake valve cam phaser and into a full advance valve timing mode for use on an exhaust valve cam phaser. Accordingly, a coiled bias spring 44 is disposed around hub 30. A first spring tang 46 adjacent cover plate 26 is rotationally anchored to a first fixed stop grounded to stator 24 such as, for example, against a projecting pin fixed to the stator, engaged in a slot in the stator cover, or against a bolt 40*a* passing through a stator lobe (not visible) immediately adjacent to a large rotor vane 20*a* containing a locking pin mechanism 48 extending through lower face 18*a* for selectively locking the rotor to the stator under certain conditions of engine operation. A second spring tang 50 at the opposite end of coil spring 44 is axially spaced apart from first spring tang 46 by the windings of the spring and is engaged against a second fixed stop grounded to rotor 22 such as protrusion 52 formed in a rotor extension such as timing wheel 28 within annular space 36. The angular location of protrusion 52 is selected such that spring 44, when installed during assembly of phaser 10, is torsionally loaded to urge rotor 22 into the desired at-rest position with respect to stator 24.

Figure 3:
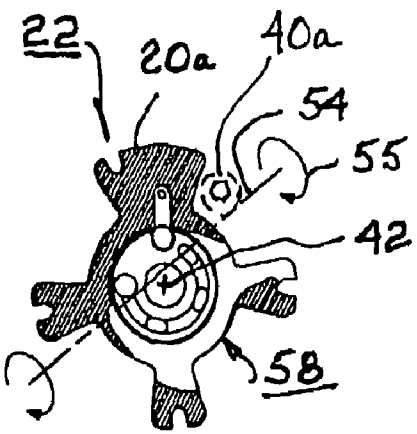
FIG. 3 (PRIOR ART)
FIG. 3 is a plan view of the upper surface of a rotor from the phaser shown in FIGS. 1 and 2, showing the prior art pattern of wear.

As noted above, an undesirable effect of first and second tangs 46,50 being spaced apart axially of axis 42 is that a torque is applied to hub 30, and thus to rotor 22, about an axis 54 transverse of (although not necessarily orthogonal to) phaser axis 42 in a first direction 55, as shown in FIG. 3.

In effect, the rotor is cocked slightly within stator 24 and between wheel hub surface 16 and inner surface 56 of cover plate 26, which surfaces are the sealing surfaces for rotor vanes 20. Leakage across these surfaces between the advance and retard chambers results in loss in performance of the phaser, degraded performance of the locking pin mechanism (because the leakage occurs across the face of the large vane carrying the locking pin), and parasitic loss of oil flow to the engine.

Figure 4:
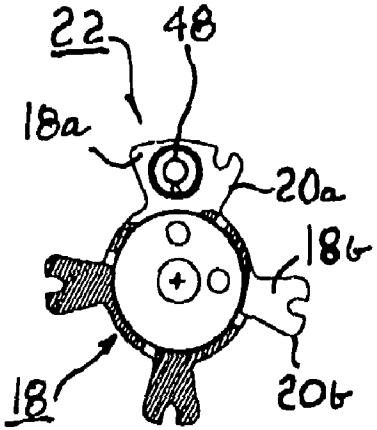
FIG. 4 (PRIOR ART)
FIG. 4 is a plan view of the lower surface of a rotor from the phaser shown in FIGS. 1 and 2, showing the prior art pattern of wear.

Referring now to FIGS. 3 and 4, FIG. 3 shows the upper surface 58 of a rotor 22 and FIG. 4 shows the lower surface 18 of rotor 22. Wear patterns from contact with the wheel hub and cover plate respectively in a prior art phaser are indicated by shading. The wear patterns indicate areas of excellent contact and low leakage between the rotor vanes and their mating surfaces; conversely, areas without wear patterns represent areas without contact with their mating surfaces wherein oil flow may occur across the vanes. It is seen in FIG. 4 that oil leakage can occur across the lower surface 18*a* of all of large vane 20*a* and the lower surface 18*b* of a normal vane 18*b*. Significant leakage can also occur across the upper surface of rotor 22, as shown in FIG. 3.

Figure 2:
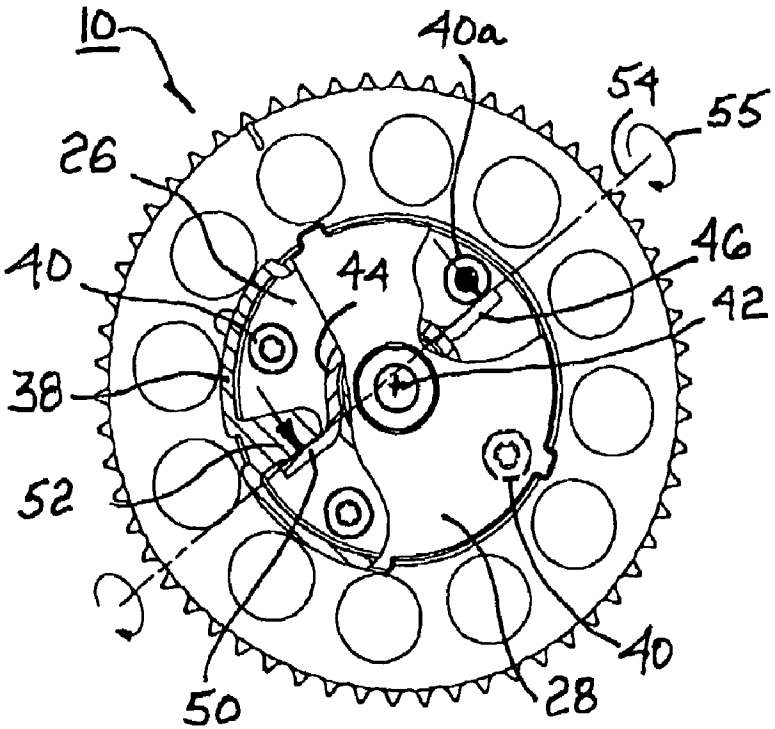
FIG. 2 (PRIOR ART)
FIG. 2 is a plan view in cutaway of the phaser shown in FIG. 1, showing the prior art orientation and bearing points of a biasing spring.
Figure 8:
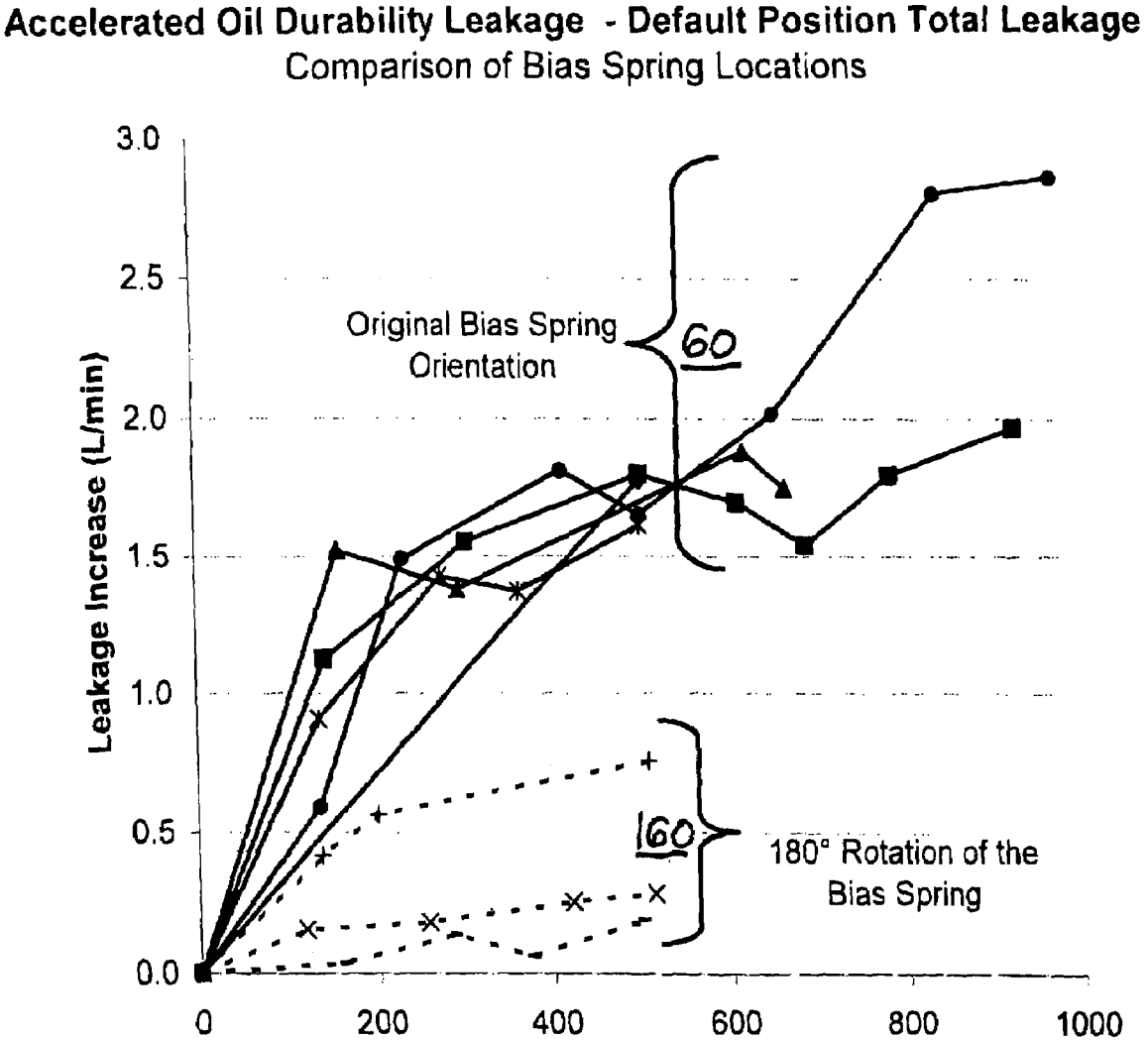
FIG. 8 is a graph showing oil leakage after accelerated wear operation for five prior art camshaft phasers and for three camshaft phasers modified in accordance with the invention.

Referring to FIG. 8, curves 60 are shown representing oil leakage rates for five prior art phasers, each having a bias spring disposed as shown in prior art FIGS. 1 and 2. The phasers were subjected to identical accelerated wear tests, being periodically cycled at short intervals from full advance to full retard on a test bed engine supplied with an abrasive oil. The rotor wear patterns shown in FIGS. 3 and 4 are representative of wear displayed by the five phasers of curves 60. It is seen that after 500 hours, all the phasers had increased leakages of at least 1.5 liters of oil per minute, and the wear and leakage continued to increase almost linearly for at least one of the phasers when testing was extended to nearly 1000 hours.

Figure 7:
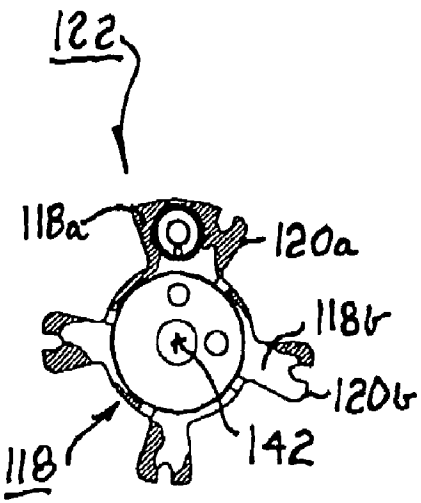
FIG. 7 is a plan view of the lower surface of a rotor from the phaser shown in FIG. 5, showing an improved pattern of wear.
Figure 6:
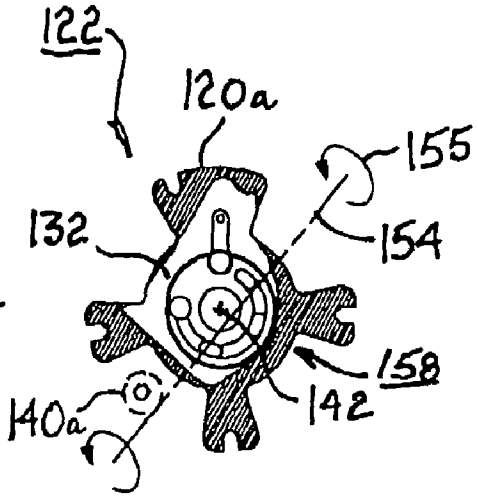
FIG. 6 is a plan view of the upper surface of a rotor from the phaser shown in FIG. 5, showing an improved pattern of wear.
Figure 5:
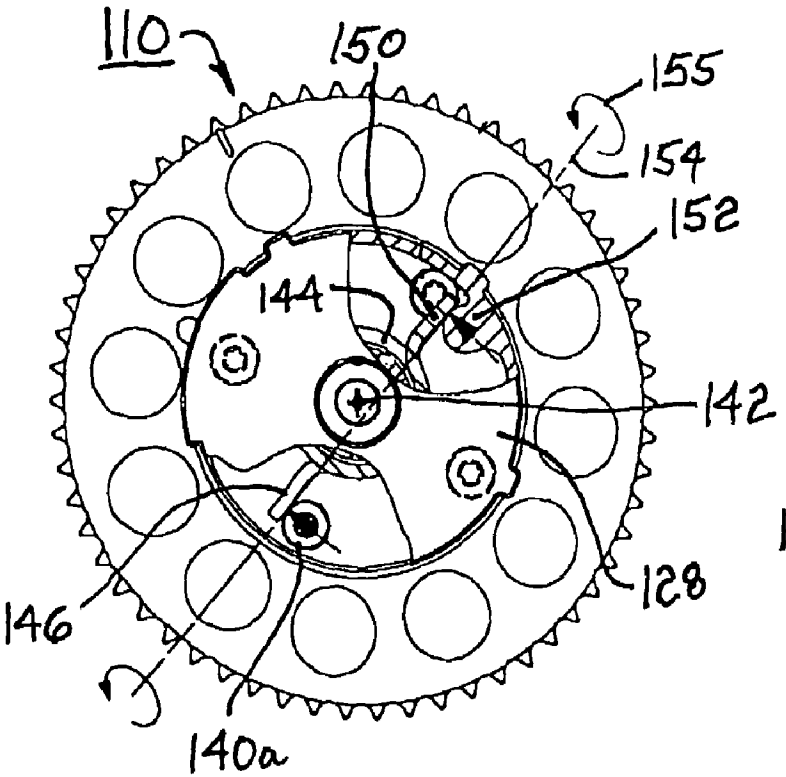
FIG. 5 is a plan view in cutaway of a phaser in accordance with the invention, showing the improved orientation and bearing points of a biasing spring.

Referring now to FIGS. 5 through 7, an improved camshaft phaser 110 in accordance with the invention is identical in all respects to prior art phaser 10 as just described, except for a change in the installed position of the rotor bias spring. Phaser elements that are either identical with prior art phaser elements or are analogous thereto are indicated by the same number plus 100.

Spring 144 is positioned at a rotational angle of about 180° from the position of prior art spring 44, which rotation serves to anchor first tang 146 against first fixed stop 140*a* generally opposite from large vane 120*a*. Similarly, second tang 150 is engaged against second fixed stop 152 located adjacent to large vane 120*a* and grounded to rotor 122. The angular location of second fixed stop 152 is selected such that spring 144, when installed during assembly of phaser 110, is torsionally loaded to urge rotor 122 into the desired at-rest position.

The effect of exchanging the positions of first and second tangs 146, 150 with respect to axis 142 is that a torque is applied to rotor 122 about an axis 154 in a second direction 155 opposite to direction 55 shown in FIG. 3. It will be recognized that transverse axis 154 thus lies beyond phaser axis 142 from vane 120*a*. Contrary to the prior art, the rotor thus is cocked slightly in the opposite direction from the prior art phaser 10. Because the various rotor vanes are not identical in size and shape, the forces exerted on all the vanes, both on upper and on lower surfaces thereof, are changed.

Referring to FIGS. 6 and 7, FIG. 6 shows the upper surface 158 of a rotor 122 and FIG. 7 shows the lower surface 118 of rotor 122. As in the prior art described above, wear patterns from contact with the wheel hub and cover plate respectively in improved phaser 110 are indicated by shading. It is seen that oil leakage no longer can occur across the lower surface 118*a* of all of large vane 120*a* and the lower surface 118*b* of a normal vane 118*b*. Potential leakage is also substantially reduced across the upper surface of rotor hub 132, as shown in FIG. 6.

Referring again to FIG. 8, curves 160 represent the increase in oil leakage rates for three improved camshaft phasers 110, each having a bias spring disposed as shown in FIG. 5. Phasers 110 were subjected to accelerated wear tests identical with the prior art phasers resulting in curves 60. The rotor wear patterns shown in FIGS. 6 and 7 are representative of wear displayed by the three improved phasers of curves 160. It is seen that after 500 hours, two of the three phasers increased in leakage by less than about 0.3 liters of oil per minute, and the other increased by less than 0.75 liters per minute. Thus, it is seen that the changed orientation of the rotor bias spring results in a relocation and decrease in rotor wear and consequent oil leakage of between about 60% and about 90%.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A vane-type camshaft phaser for varying the timing of combustion valves in an internal combustion engine, comprising:

a stator having a plurality of angularly spaced-apart lobes extending inwards defining a cavity therewithin;

a rotor disposed within said stator cavity and having a plurality of vanes equal in number to the number of said plurality of lobes extending outwards of a rotor hub, said vanes being interspersed with said stator lobes to define a plurality of alternating rotor-advancing and rotor-retarding chambers, one of said plurality of rotor vanes being larger than any of the other rotor vanes;

a first fixed stop associated with said rotor and being aligned with one of said plurality of stator lobes adjacent said larger rotor vane;

a second fixed stop associated with said stator and being generally diametrically opposed to said first fixed stop;

a coiled spring having a first tang and a second tang, wherein said first tang is axially spaced apart from said second tang, wherein said first tang is grounded to said first fixed stop, and wherein said second tang is grounded to said second fixed stop.

2. A camshaft phaser in accordance with claim 1 further comprising:

a drive wheel having a sealing hub, said stator and said rotor being disposed on said sealing hub; and a cover plate associated with said stator to enclose said rotor within said cavity.

3. A camshaft phaser in accordance with claim 1 further comprising a rotor extension fixedly coupled with said rotor, wherein said first fixed stop is located on said rotor extension.

4. A camshaft phaser in accordance with claim 3 further comprising:

a drive wheel having a sealing hub, said stator and said rotor being disposed on said sealing hub; and a cover plate associated with said stator to enclose said rotor within said cavity, wherein said rotor extension extends through an opening defined in said cover plate.

5. A camshaft phaser in accordance with claim 4 wherein said rotor extension includes a radial flange, said flange being axially spaced apart from said cover plate to define a space therebetween, wherein said first fixed stop is positioned on said radial flange.

6. A camshaft phaser in accordance with claim 5 wherein said second tang is adjacent to said cover plate.

7. A camshaft phaser in accordance with claim 5 wherein said rotor extension includes a hub, said coiled spring being disposed around said hub and positioned within said space.

8. A camshaft phaser in accordance with claim 7 wherein said rotor extension includes a skirt extending from said radial flange.

9. A camshaft phaser in accordance with claim 7 wherein said larger rotor vane includes a rotor locking pin assembly.

10. A camshaft phaser in accordance with claim 1 wherein said first fixed stop is a protrusion.

11. A camshaft phaser in accordance with claim 1 wherein said second fixed stop is a protrusion.

12. A camshaft phaser in accordance with claim 1 wherein said larger rotor vane includes a rotor locking pin assembly.

13. A camshaft phaser in accordance with claim 1 including four vanes and four lobes.

14. A vane-type camshaft phaser for varying the timing of combustion valves in an internal combustion engine, comprising:

a drive wheel having a sealing hub;

a stator disposed on said sealing hub and having a plurality of angularly spaced-apart lobes extending inwards defining a cavity therewithin;

a rotor disposed within said stator cavity and having a plurality of vanes equal in number to the number of said plurality of lobes extending outwards of a rotor hub, said vanes being interspersed with said stator lobes to define a plurality of alternating rotor-advancing and rotor-retarding chambers, one of said plurality of rotor vanes being larger than any of the other rotor vanes, each of the vanes having a surface associated with said sealing hub;

a coiled spring having a first tang and a second tang, wherein said first tang is axially spaced apart from said second tang; and means for grounding said spring to said stator and said rotor to prevent oil leakage across said surface of said large vane and said sealing hub.

15. A vane-type camshaft phaser in accordance with claim 14 wherein said means also prevents oil leakage across said surface of at least one of the other vanes and said sealing hub.

16. A method for installing a rotor-biasing spring into a vane-type camshaft phaser, the camshaft phaser including a stator and a rotor, the stator having a plurality of angularly spaced-apart lobes extending inwards defining a cavity therewithin, the rotor being disposed within the stator cavity and having a plurality of vanes equal in number to the number of the plurality of lobes extending outwards of a rotor hub, the vanes being interspersed with the stator lobes to define a plurality of alternating rotor-advancing and rotor-retarding chambers, one of the plurality of the rotor vanes being larger than any of the other rotor vanes, the spring having a first tang axially spaced apart from a second tang, the method comprising:

providing a first fixed stop associated with the rotor and positioned generally adjacent the larger rotor vane;

providing a second fixed stop associated with the stator and positioned generally diametrically opposed to said first fixed stop;

grounding the first tang against one of the first or second fixed stops; and grounding the second tang against the other of the first or second fixed stops.

17. A method for installing a rotor-biasing spring into a vane-type camshaft phaser in accordance with claim 16 further comprising:

providing a cover plate associated with the stator to enclose said rotor within the cavity;

providing an extension fixedly coupled with the rotor and extending through said cover plate;

positioning the spring around the extension.

18. A method for installing a rotor-biasing spring into a vane-type camshaft phaser in accordance with claim 17 wherein said first fixed stop is positioned on said extension.

19. A method for installing a rotor-biasing spring into a vane-type camshaft phaser in accordance with claim 18 wherein said second fixed stop is adjacent to said cover plate.

* * * * *